US005166733A

United States Patent [19]

Eliason

[11] Patent Number: 5,166,733

[45] Date of Patent: Nov. 24, 1992

[54] BLADE AND SEAL FOR PREVENTING MIGRATION OF TONER PARTICLES FROM A DEVELOPER ROLL IN AN ELECTROPHOTOGRAPHIC PRINTER

[75] Inventor: Raymond E. Eliason, Fairport, N.Y.

[73] Assignee: Xerox Corporation, Stamford, Conn.

[21] Appl. No.: 828,097

[22] Filed: Jan. 30, 1992

[51] Int. Cl.[5] ..... G03G 15/09

[52] U.S. Cl. ..... 355/251; 118/656; 355/215; 355/245

[58] Field of Search ..... 355/245, 251, 253, 259, 355/215; 118/653, 656-658

[56] References Cited

U.S. PATENT DOCUMENTS

| | | | |
|---|---|---|---|
| 3,809,012 | 5/1974 | Delvecchio | 118/653 X |
| 4,213,617 | 7/1980 | Salger | 355/215 X |
| 4,469,427 | 9/1984 | Kopp et al. | 355/215 |
| 4,523,833 | 6/1985 | Jones | 355/253 |
| 4,553,829 | 11/1985 | Bares | 355/253 |
| 4,774,541 | 9/1988 | Martin et al. | 355/259 |
| 4,779,119 | 10/1988 | Kaieda | 355/299 |
| 4,800,411 | 1/1989 | Tanaka et al. | 355/215 |
| 4,843,421 | 6/1989 | Fox | 355/253 |
| 4,897,693 | 1/1990 | Sawayama | 355/215 |
| 5,057,868 | 10/1991 | Sekino et al. | 355/215 |
| 5,073,797 | 12/1991 | Ono et al. | 355/215 |
| 5,084,733 | 1/1992 | Katoh et al. | 355/251 |

*Primary Examiner*—A. T. Grimley
*Assistant Examiner*—William J. Royer
*Attorney, Agent, or Firm*—R. Hutter

[57] ABSTRACT

In an electrophotographic printer having a photoreceptor surface for the creation of electrostatic latent images thereon and a rotating roll for conveying toner particles to a development zone adjacent the photoreceptor surface, an apparatus prevents the migration of toner particles from the roll. A blade, in contact with the roll adjacent one end thereof, causes toner particles adhering to an area of the roll to be moved toward the roll center as the roll rotates.

8 Claims, 3 Drawing Sheets

BLADE AND SEAL FOR PREVENTING MIGRATION OF TONER PARTICLES FROM A DEVELOPER ROLL IN AN ELECTROPHOTOGRAPHIC PRINTER

FIELD OF THE INVENTION

The present invention relates to a magnetic developer roll for use in conveying toner particles to a charged photoreceptor surface in an electrophotographic printing machine. Specifically, the present invention relates to a sealing device for a developer unit used therein.

BACKGROUND OF THE INVENTION

In electrophotographic printing, a charge retentive surface, known as a photoreceptor, is electrostatically charged, and then exposed to a light pattern of an original image to be reproduced to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer, which comprises, in addition to the toner particles which are intended to adhere to the photoreceptor, a quantity of magnetic carrier beads. The toner particles adhere triboelectrically to the relatively large carrier beads, which are typically made of steel. When the developer is placed in a magnetic field, the carrier beads with the toner particles thereon form what is known as a magnetic brush, wherein the carrier beads form relatively long chains which resemble the fibers of a brush. By applying this magnetic brush to a photoreceptor, the electrostatic charge on the photoreceptor will cause the toner particles to be pulled off the carrier beads and onto the photoreceptor.

Another known development technique involves a single-component developer, that is, a developer which consists entirely of magnetized toner. In such a developer, each toner particle has both an electrostatic charge (to enable it to adhere to the photoreceptor) and magnetic properties (to allow the particles to be magnetically conveyed to the photoreceptor). Instead of using magnetic carrier beads to form a magnetic brush, the magnetized toner particles in a single-component system are caused to adhere magnetically to a rotating cylinder known as a developer roll. The developer roll is typically in the form of a cylindrical sleeve which rotates about a stationary magnet assembly. The magnet assembly within the developer roll typically includes a number of magnets arranged in longitudes along the length of the developer roll with generally alternating polarities, so that magnetic lines of flux will extend to the exterior of the roll. Thus, magnetized toner particles adhere to the rotating sleeve by the force of the stationary magnets within the sleeve, and as the sleeve rotates around the magnet, particles adhering to the sleeve will be exposed to an alternating series of magnetic polarities. A metering blade is typically in continuous contact with the sleeve along one longitude of the developer roll so that the toner particles will adhere to the moving sleeve in a thin, uniform coating. When this thin layer of particles is obtained, the developer roll advances the toner particles to a developement zone adjacent the surface of the photoreceptor. In the development zone, the toner particles adhering magnetically to the developer roll are attracted electrostatically to the latent image recorded on the photoreceptor. With this technique, toner particles may be evenly distributed on the latent image.

In the prior art there are numerous modifications to the basic single-component developer system to ensure high copy quality. In U.S. Pat. No. 4,469,427 to Kopp et al., a vacuum device is described for use in removing stray toner particles from the gap between the developer roll and the photoreceptor. U.S. Pat. No. 4,553,829 to Bares discloses a single-component development system wherein the metering blade includes at least one aperture therein through which the toner particles may pass, so that the thickness of the layer of toner particles on the developer roll may be accurately controlled. U.S. Pat. No. 4,523,833 to Jones discloses a metering blade having electrodes defined therein so that the flow of magnetized toner particles on the developer roll may be controlled by means of an induced electric field. U.S. Pat. No. 4,774,541 to Martin et al. discloses a squirrel-cage device for charging toner particles so that the toner particles may be more efficiently conveyed on the developer roll to the photoreceptor.

U.S. Pat. No. 4,779,119 to Kaieda discloses a cleaning blade for use in removing residual toner from a photoreceptor (as opposed to a developer roll) in which a deformable edge portion mounted on a resilient leg engages the moving photoreceptor surface. A pair of elastic side seal members are mounted on the edge portion at locations beyond the the image recording region of the photoreceptor.

One practical problem which has been experienced with developer rolls in single-component systems is the difficulty in managing the behavior of toner particles within the housing of the developement system. Toner particles may have a tendency to migrate to the edges of the developer roll, or may drop from the developer roll and get into other parts of the machine. A particular problem occurs in the areas at the end of a developer roll, where the magnetic force of the stationary magnets within the developer roll may not provide sufficient coverage to maintain the toner particles thereon. It has thus been a common design concern to ensure a tight mechanical seal around the ends of the developer roll. In order to function properly, such a seal must not only prevent the migration of toner particles from the developer roll and subsequently into machine parts, but must also have low friction against the developer roll so there will be little mechanical resistance to decrease the efficiency of the machine as a whole. Perhaps most importantly, such seals must be long-lasting. The most common type of seal currently in use is an adhesive backed cotton felt strip faced with Teflon® felt; seals of such construction have been known to fail in as few as 3,000 copies. Such failures could result in either toner leaking into machine parts, degradating performance, or causing a visible copy quality defect on copies. Installation of such seals as is known in the prior art is difficult because such seals tend to be dimensionally imprecise and not preformed. Unfortunately, most resilient materials, such as felt, are to an extent porous, and for this reason do not form a reliable barrier to infiltration by toner particles.

It is an object of the present invention to provide a means for sealing the ends of a developer roll which is long-lasting, efficient, and which provides an acceptably small level of mechanical resistance to the motion of the sleeve of the developer roll.

SUMMARY OF THE INVENTION

In accordance with the above object, the present invention is an apparatus for preventing the migration of toner particles from the surface of a roll in the development means of an electrophotographic printer, the development means being for conveying toner particles from a supply thereof to a development zone adjacent a photoreceptor surface. The apparatus comprises a blade, in contact with the roll adjacent one end thereof, which causes toner particles adhering to an area of the roll to be moved toward the roll center as the roll rotates.

BRIEF DESCRIPTION OF THE DRAWINGS

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 4:
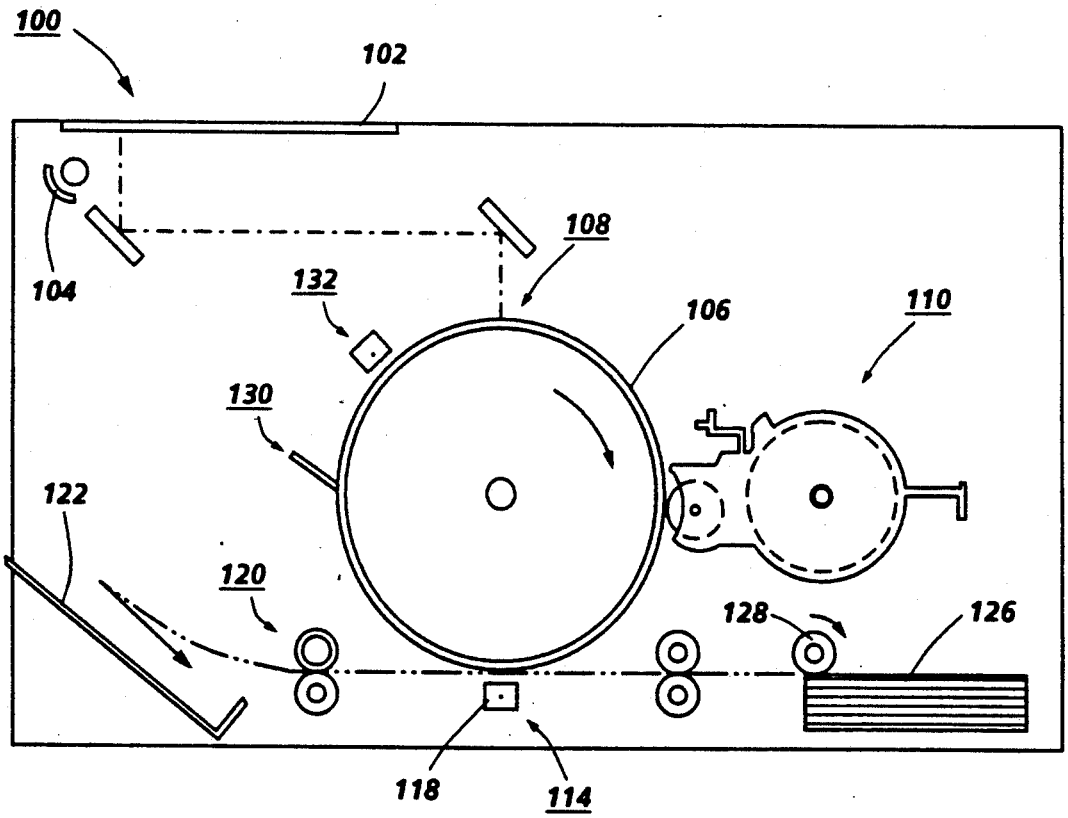
PRIOR ART FIG. 4
FIG. 4 is an elevational view showing the basic elements of a typical electrophotographic printer.

FIG. 4 shows the basic elements of a typical electrophotographic printer, shown generally by reference numeral 100. In electrophotographic printer 100, a document to be reproduced is placed on a platen 102 where it is illuminated in known manner by a light source such as a tungsten halogen lamp 104. The document thus exposed is imaged onto the photoreceptor 106 by a system of mirrors, as shown. In the example copier shown, the photoreceptor 106 is in the form of a rotating drum, although photoreceptors in the form of a belt are also known, and may be substituted therefor for purposes of the present invention. The optical image selectively discharges the surface of photoreceptor 106 in an image configuration whereby an electrostatic latent image of the original document is recorded on the drum 106 at imaging station 108. The photoreceptor drum 106 rotates so that the latent image is moved towards development station 110, where the electrostatic latent image is developed, by the application of toner particles, into visible form. In the case of a single-component development system, toner from a supply hopper is gradually conveyed by means of a rotating developer roll to the latent image recorded on photoreceptor drum 106. The details of the operation of the development station 110 will be described hereinafter.

The developed image is transferred at the transfer station 114 from the photoreceptor drum 106 to a sheet of copy paper, which is delivered from a paper supply system into contact with the drum 106 in synchronous relation to the image thereon. At the transfer station 114, a transfer corotron 118 provides an electric field to assist in the transfer of the toner particles from the photoreceptor drum 106 to the copy sheet. Individual sheets are introduced into the system from a stack of supply paper 126 by a friction feeder 128. A separated sheet from stack 126 is fed, in the embodiment shown, by further sets of nip roll pairs through a path indicated by the broken line. The image is subsequently fused onto the paper in known manner at fusing station 120 and the finished copy is deposited in hopper 122. After the toner on the drum 106 is transferred to the paper, residual toner is removed from the surface of the photoreceptor drum 106, for example by cleaning blade 130, and then the surface is recharged, as by charging corotron 132, for imagewise discharging of the photoreceptor in the next cycle.

Figure 1:
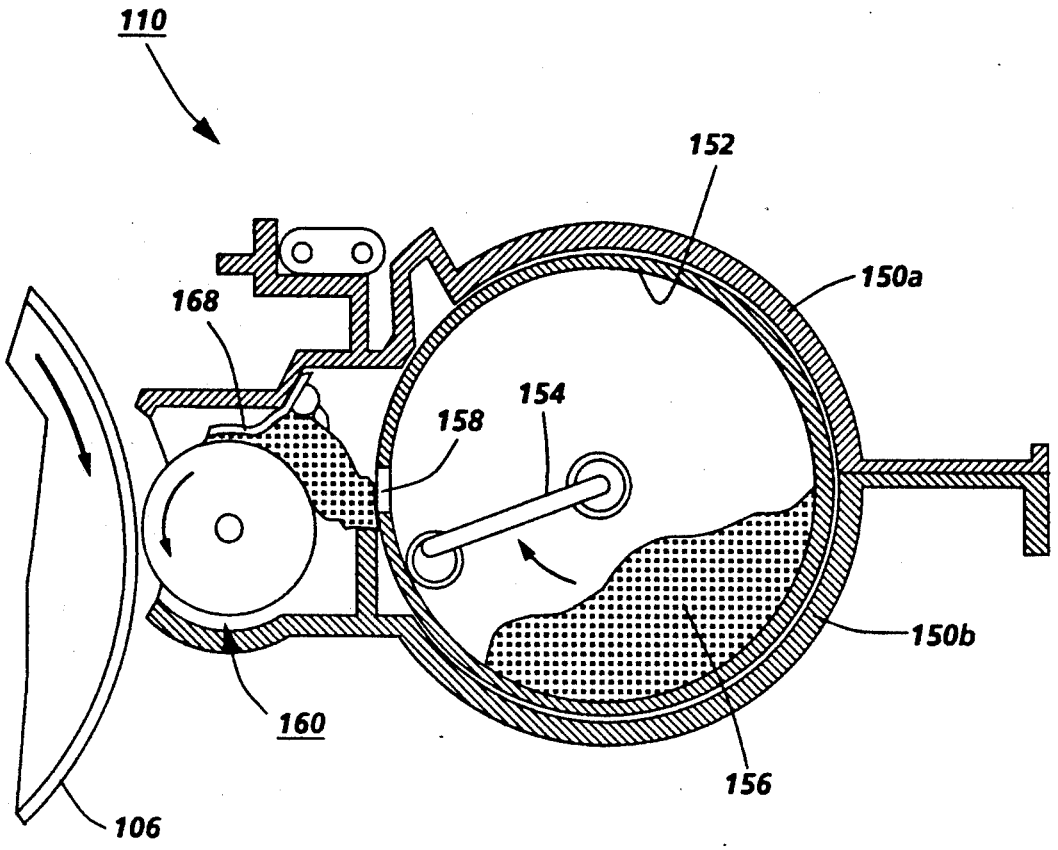
FIG. 1 PRIOR ART
FIG. 1 is an elevational view, partially in section, of an illustrative single-component developer unit used in a typical electrophotographic printer.

FIG. 1 shows a typical single-component developer station, generally indicated by reference numeral 110. As typically constructed for a commercial application, the main body of developer station 110 is encased in a developer housing, which is, in this example, in the form of a "clamshell" design, that is, formed by an upper portion **150*a* and a complementary lower portion 150*b*. These portions 150*a* and 150*b* fit together to form a single enclosure. The main part of the developer housing is, in this commercial embodiment, in the form of an enclosed cylindrical space which accommodates a cylindrical toner cartridge 152, shown in cross section. The toner cartridge 152 is typically in the form of a customer-replaceable unit (CRU), and made of an inexpensive material such as cardboard or aluminum. The toner cartridge 152 is preferably cylindrical so that it may be slid easily into the developer housing. It is typical that a CRU toner cartridge 152 may include an inexpensive rotatable agitator 154, which engages a rotating member in the copier. The purpose of agitator 154 is generally to keep the single-component developer (toner) well-mixed and aerated, so that the toner 156 will flow easily and will not coagulate in one area of the toner cartridge 152. Such an agitator 154 may also be useful in moving toner particles out of the toner cartridge 152** at a consistent rate.

No matter what the specific design of the toner cartridge 152, such a cartridge will include at least one opening 158 defined therein, in order that the toner 156 may be gradually taken out of the toner cartridge 152.

In the design shown, opening 158 is in the form of one or more openings along a longitudinal axis of the cylindrical toner cartridge 152, the opening 158 being oriented adjacent developer roll 160. In this way, toner 156 may be gradually removed from the toner cartridge 152 and conveyed by the developer roll 160 to the surface of photoreceptor 106.

Figure 2:
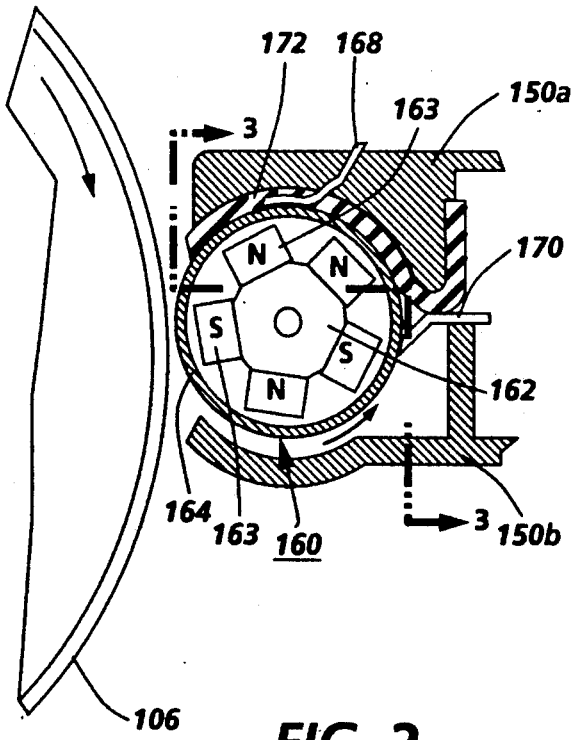
FIG. 2 is a detailed elevational view, partially in section, of an illustrative developer roll and the elements adjacent thereto.

FIG. 2 shows a typical developer roll 160 in the context of the developer station 110. The elements of a developer roll 160 in a single-component development system are a stationary magnet assembly 162, enclosed within a rotating cylindrical sleeve 164. Stationary magnet assembly 162 includes a plurality of magnets 163, with each magnet extending substantially the length of the developer roll 160, and being arranged so that a selected pole of each magnet is exposed outward. The alternating polarities of the magnets 163 create magnetic flux lines which extend outward toward the outer surface of the sleeve 164. In a typical single-component developer system, the toner particles have magnetic properties associated therewith, for example by virtue of a significant iron content, but generally no specific polarity. The magnets on magnetic assembly 162 generally cause the toner particles to adhere to the surface of outer sleeve 164, and the rotation of outer sleeve 164 causes the particles to, in effect, move around the developer roll 160 from the toner cartridge side of the developer roll 160 to a development zone adjacent the surface of the photoreceptor 106.

Metering blade 168, which can also be seen in use in FIG. 1, is an angled, somewhat resilient blade urged against the surface of the developer roll 160 along a longitude thereof. The purpose of the metering blade 168 is to smooth out the layer of toner particles on the sleeve 164 so that the layer will be uniform when it is brought into contact with the photoreceptor 106. It should be noted that, in this typical configuration of this development station 110, the developer roll 160 and the metering blade 168 are encased in substantially the same housing 150*a* and 150*b* as the toner cartridge 152. This modular design, typical in the art, is intended to ensure that loose toner particles moving from the toner cartridge 152 over the developer roll 160 to the photoreceptor 106 are not caused to spill or otherwise migrate to the rest of the machine. As toner particles are extremely fine, a severe contamination of such particles is likely to interfere with mechanical parts throughout the machine.

The present invention prevents the migration of toner particles from the rotatable sleeve 164 of the developer roll 160 by providing a doctor blade which engages the surface of the sleeve 164 in an area toward at least one end of the developer roll 160, particularly where a relatively weak magnetic field exists around the ends of the magnet structure 162. This doctor blade, shown as 170 in FIG. 2, is disposed at a point along the circumference of the sleeve 164 that is downstream of the contact area between the surface of sleeve 164 and the surface of photoreceptor 106, when the sleeve rotates in its usual process direction, as shown by the arrow in FIG. 2. When the development station 110 is physically oriented as shown in the Figures, it can be seen that doctor blade 170 engages the surface of sleeve 164 where the surface of sleeve 164 is moving upward. It should also be noted that the doctor blade 170 is oriented so that its edge is pointing against the process direction of the developer roll 160.

Figure 3:
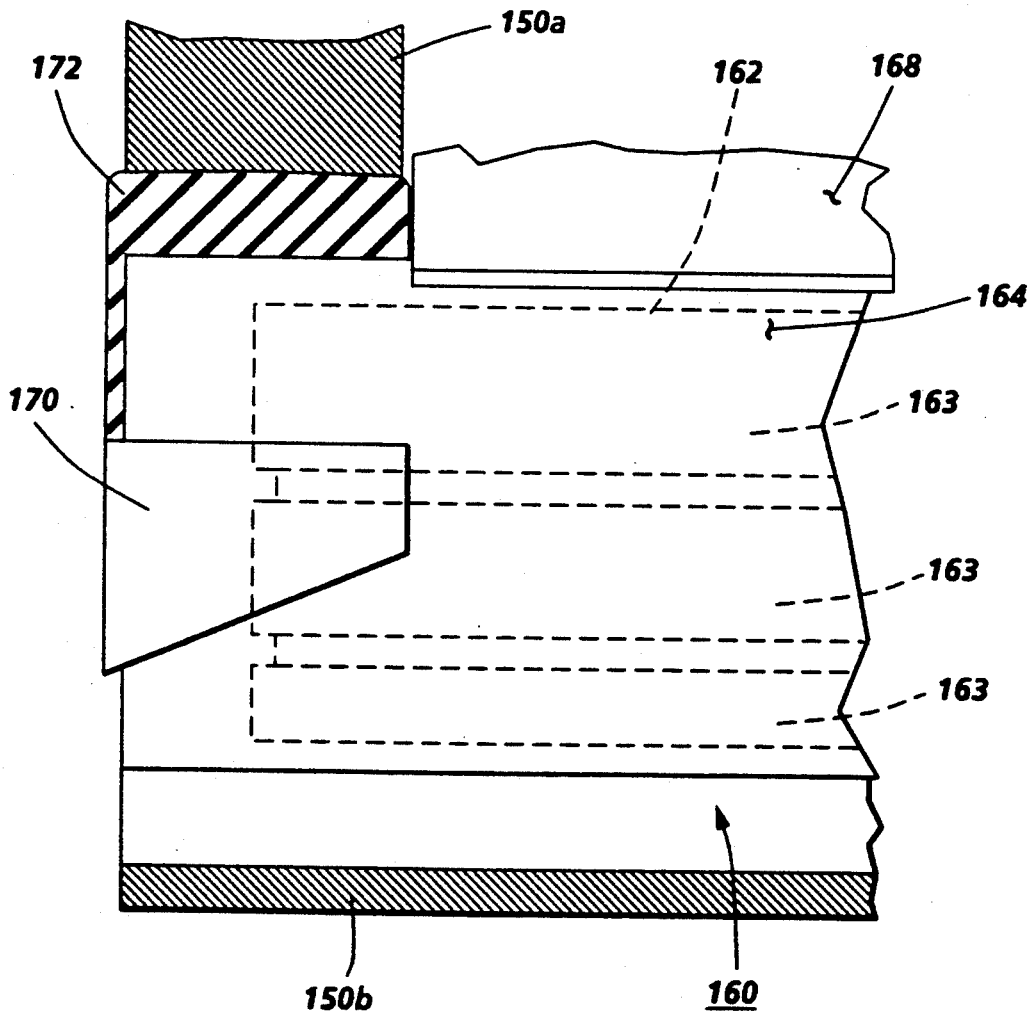
FIG. 3 is an elevational view, partially in section, taken along line 3—3 in FIG. 2 in the direction of the arrows, toward one end of the developer roll.

FIG. 3 shows the configuration of the edge of doctor blade 170, along with its location relative to the magnetic assembly 162, shown in broken lines inside sleeve 164 in developer roll 160. It can be seen that doctor blade 170 is preferably located at at least one end of the sleeve 164 such that its width overlaps the ends of the longitudinal magnets 163 on the magnet assembly 162. In this way, the edge of blade 170 will engage toner particles adhering to the sleeve 164 by the relatively weak magnetic force at the ends of each magnet 163. It will also be seen that the edge of blade 170 slopes toward the center of the developer roll 160 along the process direction (in FIG. 3, shown as upward), so that the toner particles on sleeve 164 which are engaged by the edge of doctor blade 170 will be guided by the motion of the sleeve 164 against the edge of doctor blade 170 toward the center of the developer roll 160, that is, closer to the main portions of magnets 163. When the toner particles are moved closer to the main portions of the magnets 163, it will follow that the toner particles will adhere with greater force to sleeve 164. In this way, the shape and orientation of doctor blade 170 causes toner particles which may be in danger of migrating from the sleeve 164 to be moved inward, and thus held to the sleeve 164 more tightly.

As can be seen in the Figures, sealing member 172 is preferably mounted downstream of doctor blade 170, and contacts only the area of the sleeve 164 that has been cleared by the doctor blade 170. Also important to notice in FIG. 3 is that the sealing member 172 abuts the end of the metering blade 168, which extends across the length of the sleeve 164. Sealing member 172 and metering blade 168 must form a reasonably tight seal so that toner will not penetrate the space between them. In this way sealing member 172 forms a barrier to the lateral motion of toner particles along the sleeve, particularly in the zone where toner particles collect on the upstream side of metering blade 168.

In the preferred embodiment of the present invention, doctor blade 170 is mounted on portion 150*b* in the "clam-shell" construction of the developer housing, and sealing member 172 is mounted to the complementary top portion of the developer housing 150*a*. The interface between the mounted portion of doctor blade 170 and the sealing member 172 is also the interface between the two portions of the developer housing 150*a* and 150*b*. In this way, doctor blade 170 and sealing member 172 may be conveniently urged against one another to provide a seal which avoids many of the disadvantages of prior art sealing arrangements. Sealing member 172 is preferably made of a resilient, low-friction set of materials, such as a fabric-covered elastomer, and preferably a satin acetate-faced polyurethane microfoam. The foam provides a measure of resilience, and is largely impermeable to toner particles, while the satin acetate facing provides a low frictional coefficient. It will also be noticed that a seal engaging the sleeve 164 between the contact point of photoreceptor 106 and the doctor blade 170 (that is, along the bottom of the developer roll 160 as it is shown in FIG. 4) is not necessary for efficient sealing of the end of the developer roll 160. The fact that such a seal is unnecessary means that the extra friction such a seal would create against sleeve 164 can be avoided. The sealing member 172 is disposed directly downstream of the doctor blade 170, so that most of the toner particles pushed toward the middle of the developer roll will avoid contact with the sealing member 172, thus avoiding much permeation of the sealing member 172 by toner particles and thereby extending the life of the sealing member 172.

In summary, it can be seen that the present invention provides a means for preventing migration of toner particles off a developer roll into the machine in general, while avoiding many of the problems associated with prior art sealing arrangements. Although the sealing arrangement of the present invention has been shown with a developer roll for use in a single-component development system, the invention could also be used in a two-component system wherein carrier beads in the developer form a magnetic brush on the developer roll.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. In an electrophotographic printer having a photoreceptor surface for the creation of electrostatic latent images thereon and development means for the application of toner particles to the charged areas of the latent image, the development means including a rotating roll for conveying toner particles from a supply thereof to a development zone adjacent the photoreceptor surface, an apparatus for preventing the migration of toner particles from the roll, comprising:

a blade, in contact with the roll adjacent one end thereof, adapted to cause toner particles adhering to an area of the roll to be moved toward the roll center as the roll rotates; and a sealing member engaging the roll in an area substantially immediately downstream of the blade along the direction of rotation of the roll.

2. An apparatus as in claim 1, wherein the blade is disposed downstream of the development zone in the process direction of rotation of the roll.

3. An apparatus as in claim 1, wherein the blade is disposed at an area corresponding to a marginal end region of the roll.

4. An apparatus as in claim 1, wherein the edge of the blade is angled toward the roll center in the direction of rotation of the roll.

5. An apparatus as in claim 1, wherein the blade is pointed against the direction of rotation of the roll.

6. An apparatus as in claim 1, wherein the sealing member is made from a polyurethane elastomer material.

7. An apparatus as in claim 1, further including a metering blade extending longitudinally across the developer roll, and having an end thereof sealably abutting the sealing member.

8. An apparatus as in claim 1, wherein the roll is disposed within a developer housing having a first portion and a complementary second portion, and wherein the blade is mounted to the first portion of the housing, and the sealing member is mounted to the second portion of the housing, so that the blade and sealing member engage one another when the first portion and second portion are closed, defining the housing.

* * * * *